United States Patent [19]

Borst

[11] Patent Number: 5,022,188

[45] Date of Patent: Jun. 11, 1991

[54] CLAMPING FIXTURE FOR DETACHABLY FIXING A TOOL, IN PARTICULAR A DISC

[75] Inventor: Erich Borst, Leinfelden-Echterdingen, Fed. Rep. of Germany

[73] Assignee: Robert Bosch GmbH, Stuttgart, Fed. Rep. of Germany

[21] Appl. No.: 372,349

[22] PCT Filed: Dec. 5, 1987

[86] PCT No.: PCT/DE87/00560

§ 371 Date: Jun. 14, 1989

§ 102(e) Date: Jun. 14, 1989

[87] PCT Pub. No.: WO88/04976

PCT Pub. Date: Jul. 14, 1988

[30] Foreign Application Priority Data

Dec. 24, 1986 [DE] Fed. Rep. of Germany ..... 3644441

[51] Int. Cl.[5] ..... B24B 45/00

[52] U.S. Cl. ..... 51/168; 51/170 T

[58] Field of Search ..... 51/168, 209 R, 206 R, 51/170 R, 170 T, 170 PT; 83/666, 698; 279/1 K, 1 R, 8, 97

[56] References Cited

U.S. PATENT DOCUMENTS 4,735,020 4/1988 Schulz et al. ..... 51/170 R

FOREIGN PATENT DOCUMENTS 1260181 12/1961 France .

*Primary Examiner*—Maurina Rachuba

*Attorney, Agent, or Firm*—Michael J. Striker

[57] ABSTRACT

A clamping fixture for detachably fixing a tool to a driven spindle and comprising a flange for applying a clamping force to the tool and axially displaceable relative the driven spindle and coupled to the driven spindle for transmitting a torque thereto, a supporting element for securing the flange against axial displacement relative to the spindle to prevent the flanges from applying a damping force to the tool, the supporting element comprising an annular nut member displaceably mounted on the spindle adjacent an end of the flange which is remote from the tool, and having a right-hand coarse thread to be screwed onto the threaded portion with an external coarse thread of the spindle, a torsion spring for coupling the annular nut member to the flange, and a locking device for preventing rotation of the annular nut member upon actuation of the locking device.

18 Claims, 4 Drawing Sheets

CLAMPING FIXTURE FOR DETACHABLY FIXING A TOOL, IN PARTICULAR A DISC

BACKGROUND OF THE INVENTION

The invention starts from a clamping fixture for detachably fixing a tool, in particular a disc and comprising two flanges for clamping the tool therebetween and of which one flange is axially displaceable on the spindle. Clamping fixtures, in particular for disc-shaped tools are suitable particularly for portable, power hand tools, and in this respect in particular for grinding machines. A clamping fixture of this type has been disclosed (German Patent Specification 3,012,836) in which one flange, which is arranged on the side of the tool pointing towards the housing of the power hand tool, is axially movable relative to the spindle and designed as a driving plate. This rear supporting flange is coupled to the spindle in such a way as to transmit torque and is axially supported in an end position on a shoulder of this spindle. The other flange, which can be screwed onto the end of the spindle, consists of a nut having a separate clamping element which is roughly pot-shaped in cross-section and is supported axially against the flange of the clamping nut via a coil spring. When this clamping nut is screwed on and tightened, the pot-shaped clamping element is pressed axially against the tool via the axially compressed spring, and the tool is thereby tightened against the flange on the spindle side, the end face of a cylindrical extension of the clamping nut coming to bear directly on a facing axial side of the rear flange and, during further tightening of the clamping nut, this rear flange on the spindle side being tightened together with the clamping nut, if necessary until the rear flange comes to bear axially on the shoulder surface of the spindle. In an angle grinder, the grinding disc is thereby supposed to be mounted with a defined contact pressure and this contact pressure is supposed to be ensured. This clamping fixture is also intended to enable a quick and simple interchange of the grinding disc and at the same time avoid overloading of the power hand tool, in particular the angle grinder. This is because, if the torque acting on the grinding disc is too great, the grinding disc stops, while the rear flange and also the clamping nut having the clamping member, perform a relative movement thereto. The effect of the clamping nut automatically tightening further in operation, makes it considerably more difficult to loosen the clamping nut when changing the grinding disc. Therefore loosening of the clamping nut is here only possible with the assistance of a special auxiliary tool, the spindle, depending on the design of the machine, having to be appropriately counterheld by a second auxiliary tool, e.g., a spanner.

SUMMARY OF THE INVENTION

The object of the invention is to provide a clamping fixture in which a tool change is possible without any auxiliary tool, which tool change, in addition, can be performed quickly and safely. The clamping fixture is shifted from the front area, exposed when used as specified, into the area between tool and bearing flange of the housing so that any risk of damage, e.g. chafing on the work piece, is countered. Furthermore, the clamping fixture is simple and robust in construction as well as adequately protected against dirtying from the outside. Any wear of functionally important parts is taken into account. Simple and easy two-hand operation is achieved. The front clamping nut is taken over unchanged in a known manner so that recourse can be made here to standardised, cost-effective parts. At the same time, it is still possible in especially stubborn cases, e.g. in the event of a rusted-in clamping nut, for a spanner to be placed thereon, and the clamping nut can be released with this auxiliary tool. The supporting flange is in a rotationally fast positive-locking connection with the spindle so that relevent regulations are complied with. In addition, the supporting flange is removably attached, which further facilitates the tool change.

The novel features which are considered as characteristic for the invention are set forth in particular in the appended claims. The invention itself, however, both as to its construction so to its mode of operation, together with additional objects and advantages thereof, will be best understood from the following description of preferred embodiments when read in connection with the accompanying drawings.

DESCRIPTION OF THE PREFERRED EMBODIMENTS

Figure 1:
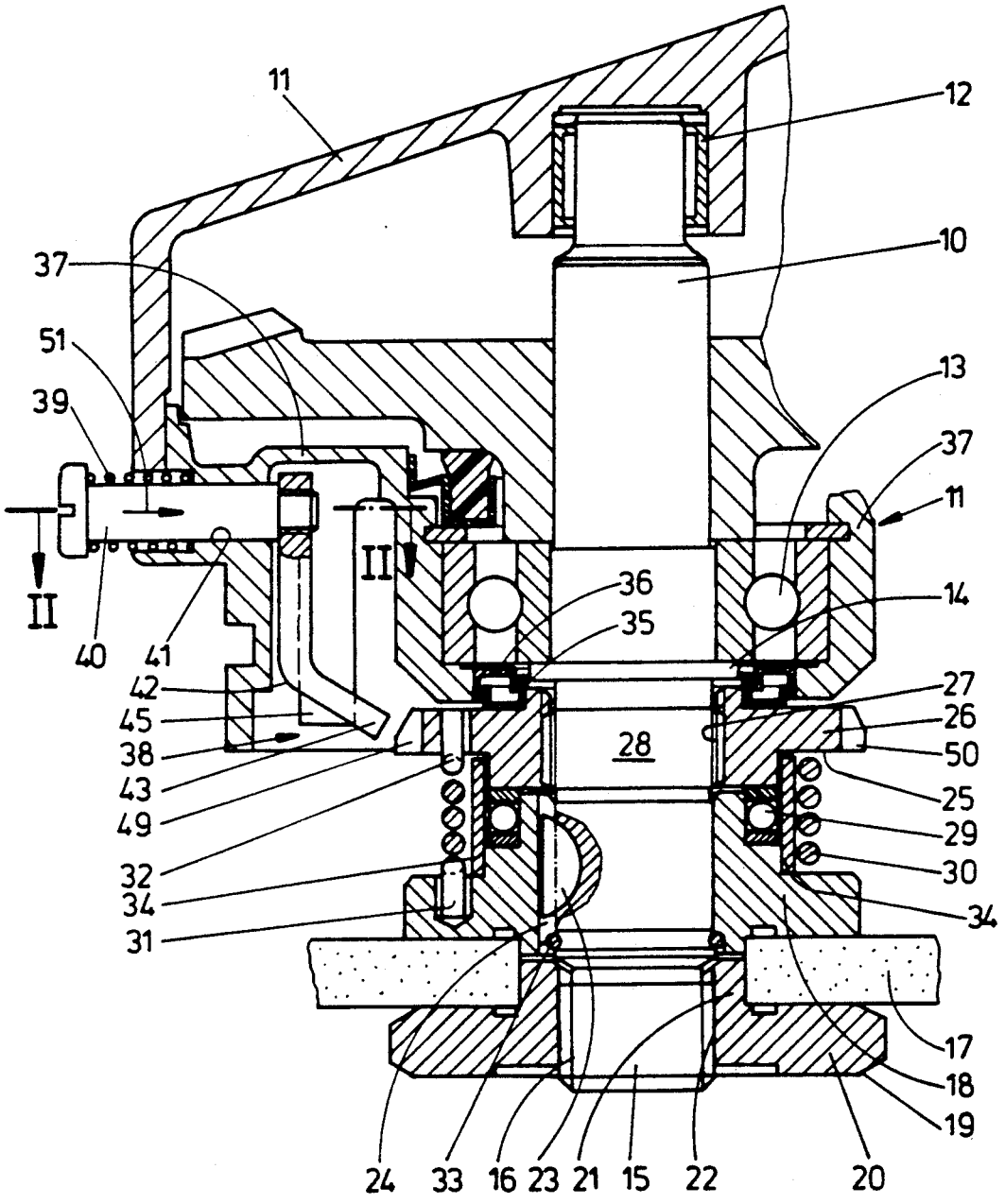
FIG. 1 shows a schematic axial longitudinal cross-sectional view of a first embodiment of a clamping fixture according to the present invention as part of an angle grinder having a mounted grinding disc.
Figure 2:
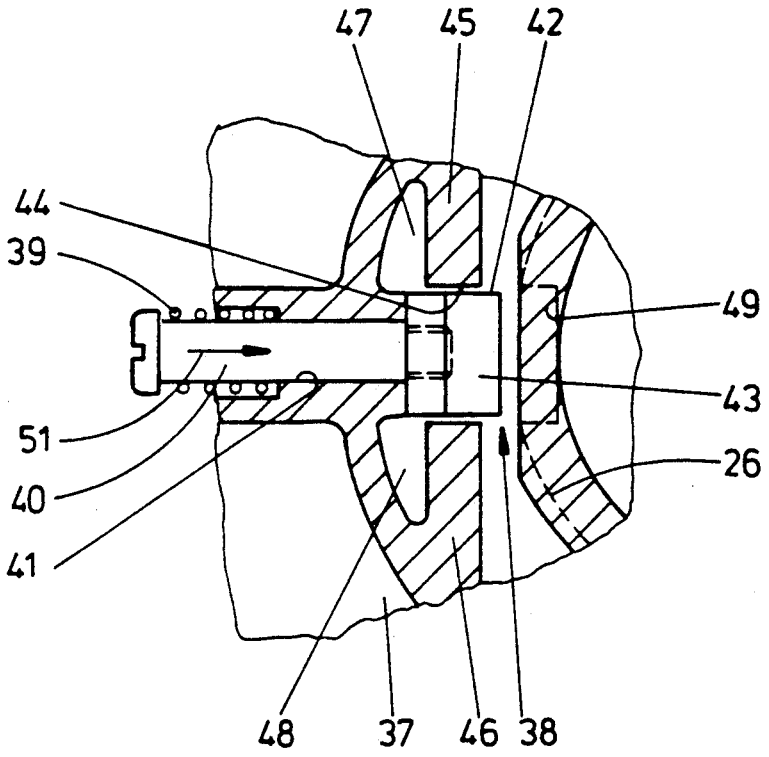
FIG. 2 shows a schematic sectional view along line II—II in FIG. 1 of a detail of the clamping fixture.

FIG. 1 schematically shows the lower part of a portable power hand tool which is designed, for example, as an angle grinder and has a spindle 10 which is motor-driven via a gearing and is supported in housing 11 at one end by a needle bearing 12 and, at an axial distance therefrom, by a ball bearing 13. The inner ring of the ball bearing 13 is axially supported on a shaft collar 14. At the end, the spindle 10 is provided with a threaded portion 15 which has an external thread 16. The spindle 10 serves to drive a tool 17 which consists, for example, of the grinding disc as shown or another tool disc, e.g. a cup wheel, brush, a rubber plate or the like. The tool 17 is detachably fixed on the spindle 10 by a clamping fixture. The clamping fixture has two flanges 18 and 19 between which the tool 17 can be clamped axially in place. One flange 19 is formed by a clamping nut 20 which has a hub part 21 and a through internal thread 22 with which the clamping nut 20 is screwed onto the external thread 16. The tool 17, during fixing, is centred on the outer peripheral surface of the hub part 21.

The other flange 18 forms a mating flange. It is held in an axially displacable manner on the spindle 10 and in the process is coupled to the spindle 10 in such a way as to transmit torque. Used for this purpose is a slot-and-key connection having a Woodruff key 23 which is accommodated in a positive-locking manner in the spindle 10 and engages into an axial through groove 24 of the flange 18.

On the axial side of the flange 18 remote from the tool 17, a supporting element is arranged on spindle 10 so as to be movable relative thereto, which supporting element consist of an annular part 25 and is here designed as a nut 26. The nut 26 is located at least a slight axial distance from the flange 18. It has an internal thread 27 with which it is movable on the thread on a threaded portion 28 of the spindle 10. The external thread of the threaded portion 28 and the internal thread 27 of the nut 26 are each designed as right-hand coarse threads whose lead angle is selected to be of such a size that the coarse in the reliable self-locking range.

Arranged axially between the flange 18 and the nut 26 is an axial ball bearing 29 via which the flange 18 is supported axially on the nut 26.

Placed between the flange 18 and the nut 26 is a torsion spring 30 which acts with one leg end 31 on the flange 18 and with its other leg end 32 on the nut 26. The nut 26, via the coarse thread of the threaded portion 28, is pressed against the axial ball bearing 29 by the force of the torsion spring 30. This axial screw force is transmitted to the flange 18 whose axial displacement in the direction away from the nut 26 is limited by a stop 33 in the form of a snap ring on the spindle 10.

An axial movement of the nut 26 relative to the spindle 10 and in the direction away from the flange 18 is limited by the shaft collar 14 of the spindle 10.

Fixed to the flange 18 is a cylindrical protection sleeve 34 which extends axially over at least an area of both the flange 18 and the nut 26 and as a result protectively covers in this area the flange 18, the nut 26 and axial intermediate area between the two. The protection sleeve 34 provides the radial support to the outside for the unrestrained balls of the axial ball bearing 29 and at the same time seals off to the outside the area between the nut 26 and the flange 18. The protection sleeve 34 overlaps the nut 26 axially with clearance for movement so that it does not prevent the relative movement of the nut 26 relative to the spindle 10 plus flange 18.

In addition, arranged on axial side of the nut 26 remote from the flange 18 are two sealing rings 35, 36, of which one 35 is held on the nut 26 and the other 36 is held on a part of the bearing flange 37 of the housing 11. The two sealing rings 35, 36 together form a double labyrinth and protect the axial ball bearing 29 and the coarse thread of the threaded step 28 as well as the internal thread 27 of the nut 26 from dirt.

A locking device 38 accessible and operable from outside is allocated to the nut 26. This locking device 38 has a thrust bolt 40 which is loaded by a spring 39, is reset into the inactive disengagement position and is held and guided in a guide 41 of the bearing flange 37 so as to be radially displacable in a translatory manner with regard to the spindle 10. At the end on the inside, the thrust bolt 40 carries a locking member 42 which, when the locking device 38 is actuated, can prevent the nut 26 from turning. The locking member 42 here consists of a roughly strip-like finger 43 angled at the lower end. This finger 43 is secured against tilting or turning about the axis of the thrust bolt 40 and guided in a guide 44. The guide 44 is formed, for example, by two adjacent ribs 45, 46 of the housing 11. Recesses 47, 48 adjacent to the ribs 45, 46 ensure that the translatory movement of the finger 43, triggered by displacement of the thrust bolt 40, is not blocked, for example by dirt or such like trapped impurities.

On the outside, the nut 26 has at least one, conveniently a plurality of catch openings 49, 50 which are arranged at equal circumferential angular distances from one another, are open to the outside and towards the finger 43 and are adapted to the dimensions of the finger 43 in such a way that the finger 43 fits into the catch openings 49, 50 when the thrust bolt 40 is pressed in a direction of arrow 51 by hand.

If the tool 17 is to be removed and changed, the thrust bolt 40, when the motor is switched off, is pressed by one hand from the outside in the direction of arrow 51 up to the stop, and the other hand takes hold of the tool 17 and rotates the latter together with the clamping fixture including the flange 18, the spindle 10 and nut 26 until the finger 43 engages into a catch opening 49 or 50 moving into its area, whereupon the nut 26 is prevented from turning during this rotation. The thrust bolt 40 is then held by hand in this engaged position. At the same time, the other hand exerts a torque on the tool 17 in anti-clockwise direction. This torque is transmitted by the tool 17 via the flanges 18, 19 to the spindle 10 and its threaded step 28 having a coarse thread. If the torque exerted by hand in this manner now becomes greater than the friction moment in the coarse thread including the torque of the torsion spring 30, the nut 26 is released from its axial contact with the axial ball bearing 29 and, during further rotation, is displaced axially in a direction away from the flange 18 up to the stop at the shaft collar 14. Consequently, the axial ball bearing 29 and with it the flange 18 become freely movable axially so that the clamping pressure effective between both flanges 18 and 19 and clamping the tool 17 in place drops and the clamping nut 20 is relieved. The latter can now be fully unscrewed from the threaded step 15 by hand and then the tool 17 can be replaced.

The release moment at the periphery of the tool 17 is dependant upon the lead angle of the coarse thread on the threaded step 28 and the nut 26. The greater the lead angle, the smaller the release moment. This lead angle is established in such a way that the coarse thread of the threaded step 28 and the internal thread 27 of the nut 26 lie in the reliable self-locking range, and in fact while allowing for the torque of the torsion spring 30, which torque counteracts the release moment.

If the tool 17 has been exchanged for another and if this other tool is to be clamped, the locking device 38 is again actuated by hand in the manner described above so that the finger 43 engages into a catch opening 49, 50 of the nut 26. The clamping nut 20 is screwed down gently with the other hand and thus the new tool 17 is likewise gently tightened. This is sufficient, since, when the motor is subsequently switched on, the tool 17 tightens automatically in operation.

The axial ball bearing 29' arranged between the nut 26 and the flange 18' has the advantage that the surface friction between the two is thus reduced to a rolling friction and is thus virtually negligibly small.

The clamping fixture described has manifold advantages. It lies in the protected area between the tool 17 and the bearing flange 37 extending thereabove, and the risk of any damage or impairment when using the power hand tool as specified is completely averted. What is more, reliable protection against dirt, dust and other contaminants is obtained by simple means. The clamping fixture is simple and robust in construction. Any wear of functional parts of this fixture is reduced to a minimum or even eliminated completely. The clamping fixture is exceptionally simple, cost-effective and quick, safe and easy to handle. It enables the tool 17 to be quickly and safely changed without requiring any additional special tools for this purpose. Simple and easy two-hand operation is achieved. In the process, the standardised clamping nut 20 present in other machines will be retained unchanged, as will a rotationally fast, positive-locking connection between the flange 18 supporting the tool 17 and the spindle 10. Thus corresponding relevant regulations are complied with. In addition, it is advantageous that the flange 18 is mounted undetachably on the spindle 10. The clamping fixture is not restricted to grinding discs such as tool 17. On the contrary, other tools, e.g. cup wheels, brushes, rubber plates or the like can be also be clamped without auxiliary tool.

Locking devices for the spindles of angle grinders are known per se. In known power hand tools, however, these locking devices are located in the gearing space. The design according to the invention differs therefrom in that the locking device 38 is instead arranged in the area of the bearing flange 37 and the ball bearing 13. This shifting of the spindle-locking device has the advantage that sealing problems do not occur and, furthermore, catch openings necessary at the crown wheel for the positive locking of the spindle are dispensed with, as a result of which the crown wheel comes substantially cheaper and also the configuration of the housing 11 becomes simpler and more cost-effective. In addition, the stress on the individual parts of the spindle-locking device is substantially reduced. During release, the stress is, for example, only about 6% of that of any other known spindle-locking devices. The advantage of the lateral arrangement of the thrust bolt 40 accessible from outside is also retained here in the locking device 38 according to the invention. Each time before the tool 17 is clamped the nut 26 is positively returned into the initial position via the locking device 38.

Figure 3:
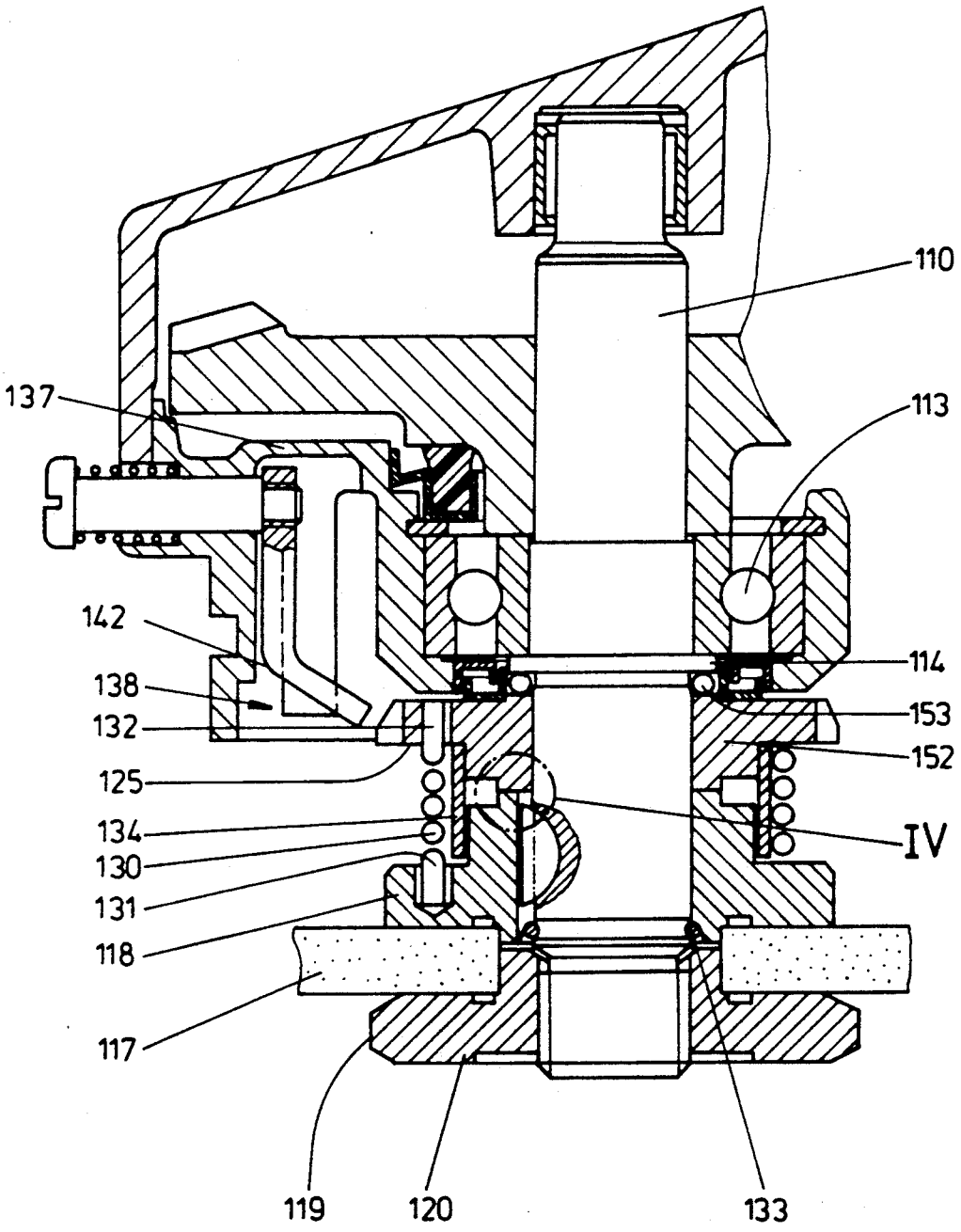
FIG. 3 shows a schematic axial longitudinal cross-sectional view roughly corresponding to that in FIG. 1 of a second embodiment of a clamping fixture according to the present invention.
Figure 4:
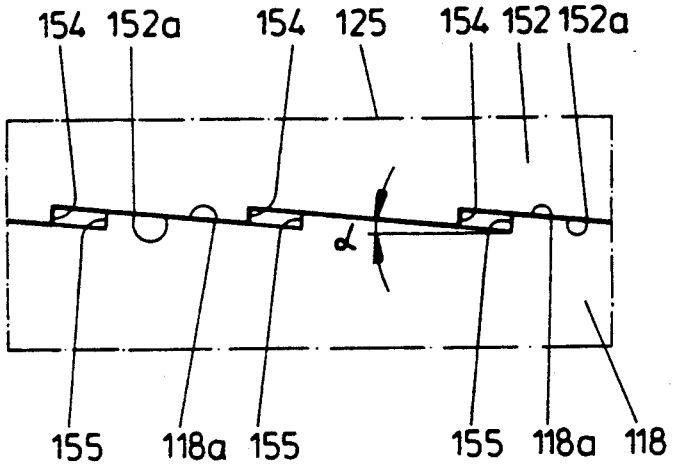
FIG. 4 shows a developed side view of detail IV in FIG. 3.

In the second embodiment shown in FIGS. 3 and 4, reference numerals increased by 100 are used for the parts which correspond to the first embodiment so that reference is thereby made to the description of the first embodiment to avoid repetitions.

The second embodiment differs from the first embodiment in that the annular part 125 which serves as supporting element for the flange 118 consists of a disc 152 which is displacable and rotatable relative to the spindle 110. The spindle 110, instead of being provided with the threaded portion 28 as in the first embodiment, is provided in this area with a continuous cylindrical outer peripheral surface.

The axial ball bearing arranged axially in the first embodiment between the annular part 25 and a nut 26 is omitted in the second embodiment. Arranged instead on the axial side of the disc 152 remote from the flange 118 is a schematically indicated axial ball bearing 153 on which the disc 152, with the facing axial side, is supported. The axial ball bearing 153 is in turn supported on the shaft collar 114 of the spindle 110.

The cylindrical protection sleeve 134 is here firmly attached to the disc 152. It covers an axial part of the flange 118 and does this with clearance for movement. As in the first embodiment, the disc 152 and the flange 118 are coupled by the torsion spring 130.

As apparent in particular from FIG. 4, both the disc 152 and the flange 118, on the end faces axially facing one another, have, e.g., three sloping surfaces 152*a* and 118*a* respectively, which follow one another at distances in the peripheral direction and are inclined to the left. The sloping surfaces 152*a*, 118*a* are axial wedge surfaces with which the flange 118 and the disc 152 bear axially against one another, as follows from the developed view according to FIG. 4.

In this arrangement, the wedge angle $\alpha$ of these sloping surfaces 152*a*, 118*a* is selected to be of such a size that it lies in the reliable self-locking range.

The torsion spring 130, which, as in the first embodiment, is supported with one leg end 132 on the disc 152 and with its other leg end 131 on the flange 118, rotates the disc 152 and the flange 118 relative to one another in such a way that both parts slide up on the sloping surfaces 118*a*, 152*a* and are thereby move apart axially. This axial spreading movement is limited in one direction by the shaft collar 114 and in the other direction by the stop 133 in the form of the snap ring of the spindle 110.

If the tool 117 is to be removed and changed, first of all, as has been described for the first embodiment, the disc 152 is rotationally locked by the locking device 138, which is designed just as in the first embodiment. If the tool 117 is then rotated anti-clockwise by the other hand, the flange 118 and the spindle 110 are also driven along in the process. The rotation of the flange 118 anti-clockwise causes the sloping surfaces 118*a* of the flange 118 to slide towards the wedge bottom of the sloping surfaces 152*a* of the rotationally locked disc 152, which leads to corresponding axial relief, whereupon the clamping nut 120 becomes loose and can easily be unscrewed fully by hand. The sliding movement of the flange 118 with the sloping surfaces 118*a* towards the wedge bottom of the sloping surfaces 152*a* is limited by locking surfaces 154 of the disc 152 and 155 of the flange 118, which locking surfaces 154 adjoin the sloping surfaces and are directed axially towards one another. These locking surfaces 154, 155 form dog steps.

As soon as the releasing torque is reduced to zero when the tool 17 is being released, the torsion spring 130 is able to rotate the flange 118 relative to the disc 152 so that the sloping surfaces 118*a* of the flange 118 slide towards the wedge top on the sloping surfaces 152*a* of the disc 152, as a result of which the two parts 152, 118 are again thrust apart axially. The tool 117 is clamped in the thrust-apart position.

In another embodiment (not shown) rolling bodies are located between the sloping surfaces 118*a*, 152*a*, as a result of which the surface friction between the sloping surfaces 118*a*, 152*a* is further reduced.

While the invention has been illustrated and described as embodied in a clamping fixture for detachably fixing a disc-type tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamping fixture for detachably fixing a discs-like tool to a driven spindle having a threaded portion with an external coarse thread, said clamping fixture comprising a flange for applying a clamping force to the tool, said flange being axially displaceable relative to the driven spindle and coupled with the driven spindle in a torque transmitting relationship; a supporting element for supporting said flange and displaceable relative to said spindle to prevent said flange from applying a clamping force to said tool, said supporting element comprising an annular nut member displaceably mounted on the spindle adjacent an end of said flange which is remote from the tool, and having a coarse thread to be screwed onto the threaded portion with an external coarse thread of the spindle; a torsion spring for directly coupling said annular nut member with said flange and having opposite ends connected to said annular nut member and said flange, respectively; and a locking device including a locking member for preventing rotation of said annular nut member upon actuation of said locking device.

2. A clamping fixture according to claim 1, wherein a lead angle of a coarse thread is so selected that it lies in a reliable self-locking range of the coarse thread.

3. A clamping fixture according to claim 1, further comprising an axial bearing located between said flange and said annular nut member.

4. A clamping fixture according to claim 3, wherein said axial bearing is a ball bearing.

5. A clamping fixture according to claim 1, wherein the spindle has a collar, said annular nut member comprising a disc portion axially displaceable and rotatable relative to the spindle, said clamping fixture comprising an axial bearing for supporting said disc portion on the collar of the spindle.

6. A clamping fixture according to claim 5, wherein said bearing is a ball bearing.

7. A clamping fixture according to claim 1, further comprising a slot-and-key connection for coupling said flange to the spindle.

8. A clamping fixture according to claim 1, further comprising stop means for limiting axial displacement of said flange in a direction away from said annular nut member.

9. A clamping fixture according to claim 8, wherein said stop means for limiting axial displacement of said flange comprises a snap ring to be secured to the spindle.

10. A clamping fixture according to claim 1, further comprising stop means to be secured to the spindle for limiting axial displacement of said annular nut member relative to the spindle.

11. A clamping fixture according to claim 10, wherein said stop means for limiting axial displacement of said annular nut member relative to the spindle comprises a collar having an end surface which is opposite to an end surface of said collar facing said annular nut member and which serves as a stop for a ball bearing supporting the spindle in a housing of a power hand tool.

12. A clamping fixture according to claim 1, further comprising a cylindrical protective sleeve extending axially over an area including at least portions of said flange and said annular nut member for covering respective portions of said flange and said annular nut member and an axial intermediate area threrebetween.

13. A clamping fixture according to claim 12, wherein said cylindrical protective sleeve is fixed to one of said flange and said annular nut member and axially overlaps with a clearance a respective portion of the other of said flange and said annular flange member.

14. A clamping fixture according to claim 1, further comprising two sealing rings arranged on an axial side of said annular nut member which is remote from said flange to form a double labyrinth thereat.

15. A clamping fixture according to claim 1, wherein said locking device includes a spring-loaded thrust bolt transversely displaceable in a power tool housing.

16. A clamping fixture according to claim 15, wherein said thrust bolt has an inner end carrying said locking member.

17. A clamping fixture according to claim 16, wherein said annular nut member has a catch opening facing said locking member, said locking member comprising a finger engaging in a positive-locking manner said catch opening upon actuation of said locking device.

18. A clamping fixture according to claim 17, wherein a housing of a power hand tool has a guide for guiding said finger, said finger being secured against rotation.

* * * * *